US005184929A

United States Patent [19]

Reynolds

[11] Patent Number: 5,184,929

[45] Date of Patent: Feb. 9, 1993

[54] MATERIAL HANDLING APPARATUS FOR TRANSFERRING AND UNLOADING A LOAD OF MATERIAL

[76] Inventor: Jay G. Reynolds, Rte. 4, Box 711, Gaffney, S.C. 29340

[21] Appl. No.: 550,696

[22] Filed: Jul. 10, 1990

[51] Int. Cl.[5] ..... B66F 9/00

[52] U.S. Cl. ..... 414/10; 294/67.22; 414/400; 414/609

[58] Field of Search ..... 187/2; 294/67.2, 67.33, 294/67.4, 67.41, 67.22; 414/10, 608, 609, 659, 662, 277, 280, 395, 396, 400, 661

[56] References Cited

U.S. PATENT DOCUMENTS

| | | | |
|---|---|---|---|
| 1,343,288 | 6/1920 | Strawn . | |
| 1,611,421 | 12/1926 | Derderian . | |
| 1,940,186 | 12/1933 | Romine . | |
| 2,609,225 | 9/1952 | Mollendorf . | |
| 2,789,857 | 4/1957 | Kesselak et al. . | |
| 3,600,030 | 8/1971 | Varon . | |
| 3,827,744 | 8/1974 | Ferdelman et al. | 294/67.4 |
| 3,831,712 | 8/1974 | Neely et al. | 187/2 |
| 3,861,546 | 1/1975 | Montgomery | 187/2 X |
| 3,876,089 | 4/1975 | Moser . | |
| 3,982,644 | 9/1976 | Pease . | |
| 4,022,330 | 5/1977 | Shannon, Jr. | 414/11 |
| 4,671,721 | 6/1987 | Pratt et al. | 414/10 |
| 4,846,627 | 7/1989 | Steuart | 414/280 X |

FOREIGN PATENT DOCUMENTS

| | | | |
|---|---|---|---|
| 2114705 | 10/1971 | Fed. Rep. of Germany | 414/280 |
| 207304 | 11/1984 | Japan | 414/280 |
| 1348297 | 10/1987 | U.S.S.R. | 414/10 |

*Primary Examiner*—Michael S. Huppert
*Assistant Examiner*—Janice Krizek
*Attorney, Agent, or Firm*—Bell, Seltzer, Park & Gibson

[57] ABSTRACT

A material handling apparatus for transferring a load of material to a work-in-storage position and unloading the material onto a floor such as in an opening of a building under construction is disclosed. The apparatus includes a platform. Extension members are supported by the platform and protrude forwardly and outwardly from the front side of the platform for protruding in an opening such as a building under construction. A material transfer is mounted to the platform for supporting a load of material thereon and is moveable on the platform onto the extension members to an extended unloading position where the material transfer is supported by the extension member to permit the unloading of a load of material supported thereon without the necessity of entering onto the platform.

2 Claims, 3 Drawing Sheets

MATERIAL HANDLING APPARATUS FOR TRANSFERRING AND UNLOADING A LOAD OF MATERIAL

FIELD OF THE INVENTION

This invention relates to a material handling apparatus for transferring a load of material to a work-in-storage position such as an elevated position above ground level and unloading the material onto a floor in an elevated building opening such as a building under construction.

BACKGROUND OF THE INVENTION

Large, bulky loads, such as a stack of sheet rock, a piano or other similar items, often are difficult to carry into buildings and transfer to the desired floor level. At construction sites having buildings with large, elevated openings, and in other environments, such as a warehouse which includes different levels of floors and platforms, heavy and bulky objects are more easily transferred by crane to a work-in-storage position adjacent the desired level and then carried onto the floor.

Various apparatus have been designed for transferring a load of material to a work-in-storage position and then unloading the material onto a floor such as in an elevated building opening. One apparatus includes a forklift on an assembly mounted to a building crane. Another apparatus includes separate means having a hoist and moveable support. One apparatus, designed especially for use at a construction site for the unloading of bulk building materials such as a stack of sheet rock into an elevated building opening, is disclosed in U.S. Pat. No. 3,827,744 to Ferdelman et al. This apparatus includes a platform having platform support extensions protruding forwardly therefrom for engaging the floor edge of an elevated building opening. An unloading ramp secured to the platform pivots downwardly from a vertical position to a horizontal position to provide a bridge between the platform and the building floor edge for permitting personnel or a forklift machine to enter onto the platform and remove the material therefrom.

However, the aforementioned apparatus disclosed in Ferdelman et al poses safety limitations. Men and machinery must enter onto the platform to remove the material therefrom. Because a crane holds the platform in an elevated position, minor crane movements or wind shifts may cause the platform to veer from the building causing a man to stumble and fall.

SUMMARY OF THE INVENTION

It is therefore an object of this invention to provide a material handling apparatus for transferring a load of material to a work-in-storage position and onto a floor such as an opening in a building under construction and which overcomes the aforementioned deficiencies of the prior art.

It is still another object of this invention to provide a material handling apparatus for transferring a load of material to a work-in-storage position and unloading the material onto a floor such as in an elevated building opening where material transfer means for supporting material thereon is moveable from a position on the platform to a position extending beyond the platform into a supported unloading position.

These and other objects and advantages of the present invention are accomplished by the material handling apparatus which includes a platform having an upper surface, an outer perimeter defining the confines of the platform and wherein one portion of the perimeter forms a front side. Extension means is supported by the platform and protrudes forwardly and outwardly from the front side of the platform.

Material transfer means is supported on the upper surface of the platform for supporting material thereon. The material transfer means is moveable on the platform from a position within the confines of the platform outwardly through the platform front side and onto the extension means to an extended unloading position where the material transfer means is supported by the extension means to permit the unloading of material supported thereon without the necessity of entering onto the platform. The material transfer means is moveable on the extension means to a position substantially outside the confines of the platform. The platform includes attachment means for fixing a hoist thereto and raising the platform.

DETAILED DESCRIPTION OF THE PREFERRED EMBODIMENT

Figure 1:
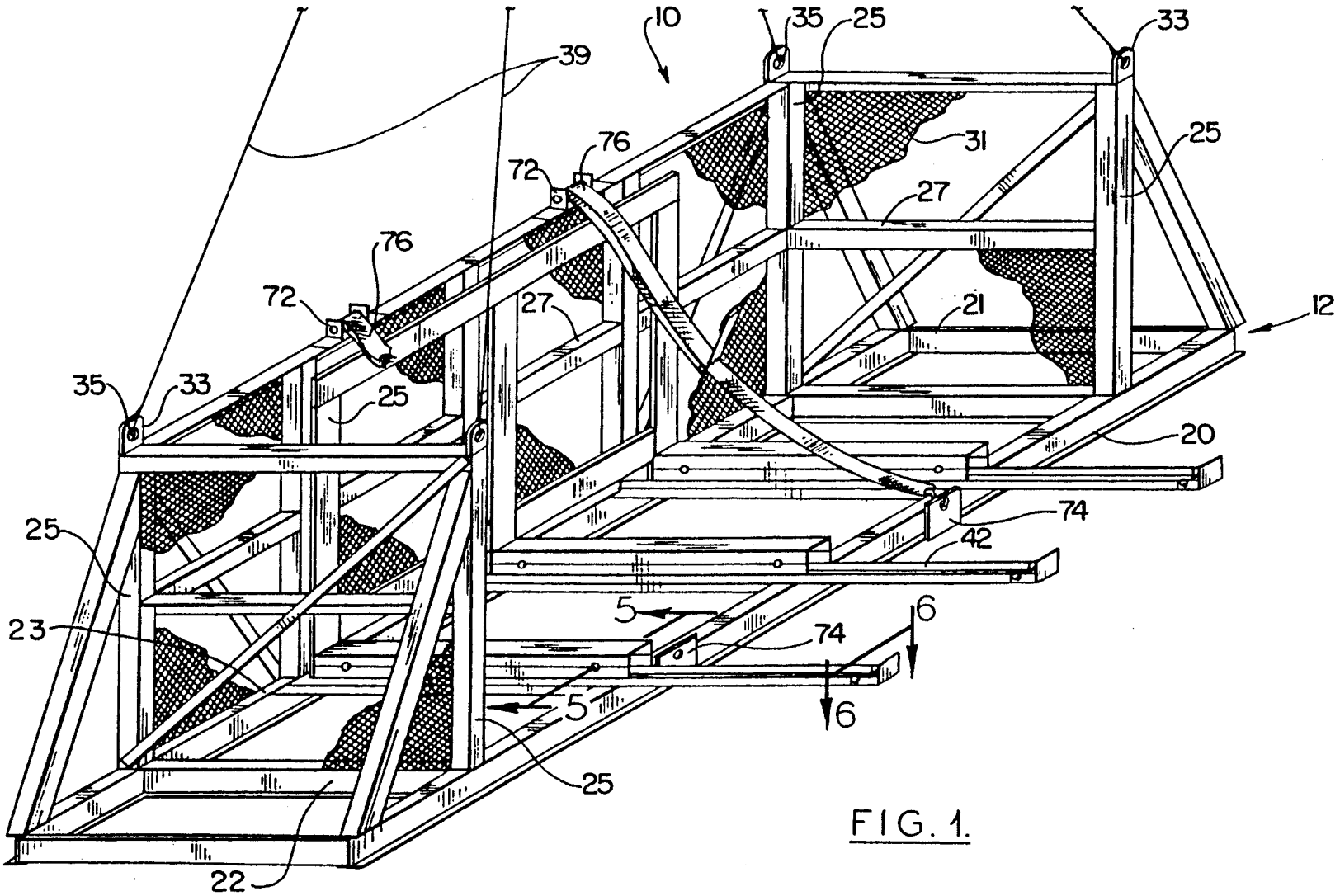
FIG. 1 is a perspective view of the material handling apparatus in accordance with the present invention.

Referring now to the drawings, and more particularly to FIG. 1, the material handling apparatus 10 in accordance with the present invention is illustrated. The apparatus 10 includes a substantially rectangular platform 12 having an outer perimeter with front 20, opposing side 21, 22 and rear edges 23 for defining the confines of the platform 12. The platform can be formed from I-beams and end braces. Support posts 25 extend upward at each corner and from the rear edge 23. Cross bracing 27 connects the support posts 25 along the side and rear edges 21, 22, 23 to define a barrier around the rear and opposing sides of the platform. Wire mesh 31 is secured to the barrier for aiding in closing the structure on the three sides. The upper portion of each support post 25 includes attachment means in the form of a flange 33 having a hole 35 for receiving a shackle or other cable attachment thereto so that hoist cables 39 can be connected to the platform for raising or lowering the platform 12 by a crane or other hoist means to an elevated position above ground level (FIGS. 2 and 3) or in other applications not illustrated, such as lowering the apparatus below ground level to a basement opening in a building under construction.

Longitudinally extending beam members 42 are fixed to the upper surface Of the platform 12 and extend laterally across the width outward beyond the front edge 20. The longitudinally extending beam members 42 extend outward beyond the front edge 20 a distance approximately the distance across the width of the platform, so that the overall length of the beam members 42 are approximately twice the Width of the platform 12. As better shown in FIG. 2, the beam members 42 protrude forwardly from the front edge 20 of the horizontal platform at an upward angle thereto. This angle is small and is on the order of no more than a few degrees difference in the horizontal plane defining the platform 12.

Figure 6:
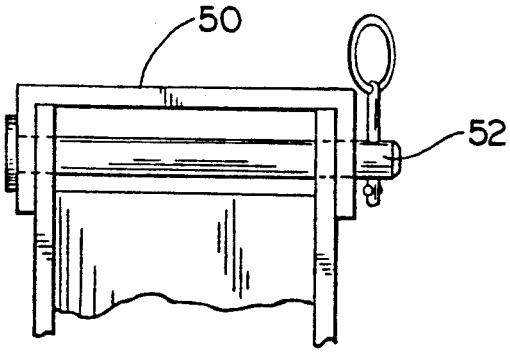
FIG. 6 is a sectional view taken along line 6—6 of FIG. 1.
Figure 5:
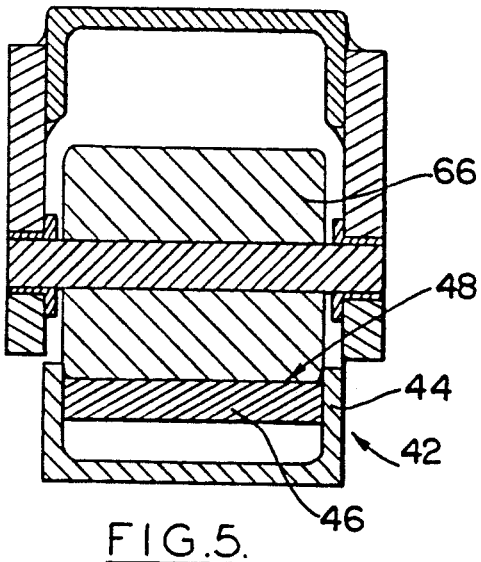
FIG. 5 is a sectional view of the beam and support members taken along line 5—5 of FIG. 1.

Each longitudinal beam member 42 is formed of a U-shaped channel member 44 having an upper plate 46 secured therewithin to form a guide passageway 48 along the upper portion of the beam members 42 (FIG. 5). Strong steel construction is preferred. Each longitudinal beam member 42 includes an end plate 50 removably secured to the beam member 42 by means of a shear pin 52 extending through the beam member and end plate for retaining the end plate thereto (FIG. 6).

Figure 3:
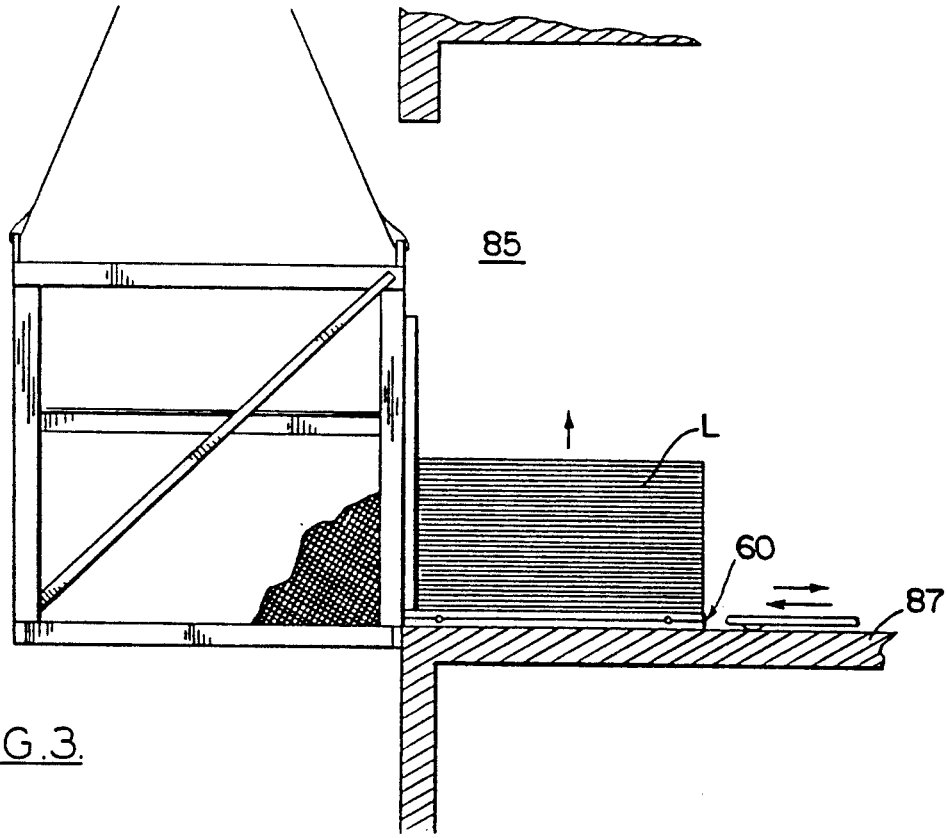
FIG. 3 is a side elevational view similar to that of FIG. 2 and showing the material transferred onto the longitudinally extending beam members engaging and resting on the edge of the floor in an elevated building opening.
Figure 4:
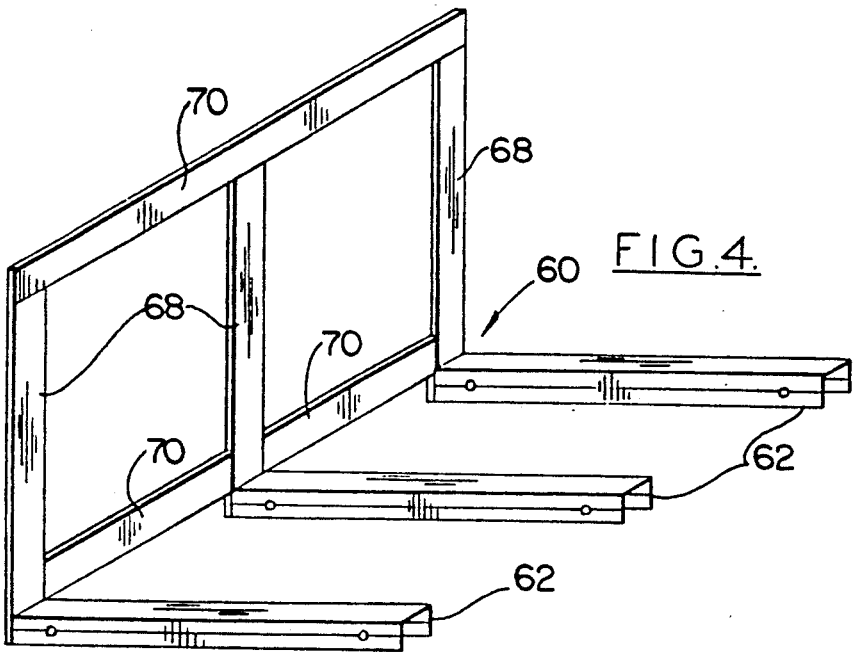
FIG. 4 is an isometric view of the material transfer means.

Material transfer means 60, (FIGS. 1, 3 and 4) for supporting material such as a load of sheet rock, is moveable on the longitudinal beam members 42 from a position within the confines of the platform 12 to an extended unloading position where the material transfer means 60 is positioned outward beyond the front edge 20 to permit unloading of material supported thereon without entering onto the platform 12. The material transfer means 60 includes support members 62 mounted onto respective beam members 42. Each support member 62 is an inverted U-shaped channel piece having a length substantially equal to the Width across the platform 12. Each inverted channel includes roller means in the form of rollers 66 (FIG. 5) mounted therewithin and dimensioned to be received onto the guide passageway 42 of the respective longitudinally extending beam member. Each support member 62 is moveable on the respective beam member 42 to a position substantially outside the confines of the platform (FIG. 3). A vertical support post 62 is positioned at the rear portion of each support member 62 and includes rigid cross members 70 interconnecting the three support posts 68 for forming a rear barrier wall, and allowing each support member to move in unison with the other support members (FIG. 4). Upper and lower sets of strap anchors 72, 74 positioned on the platform cross bracing 27 and platform front edge 20 permit support straps 76 to be secured across a load L supported on the support members 62 (FIG. 1). Guide ropes are secured on the front edge 20 of the platform. As will be explained later in detail, the guide rope aid in maneuvering the platform when adjacent a building opening.

METHOD OF OPERATION

Figure 2:
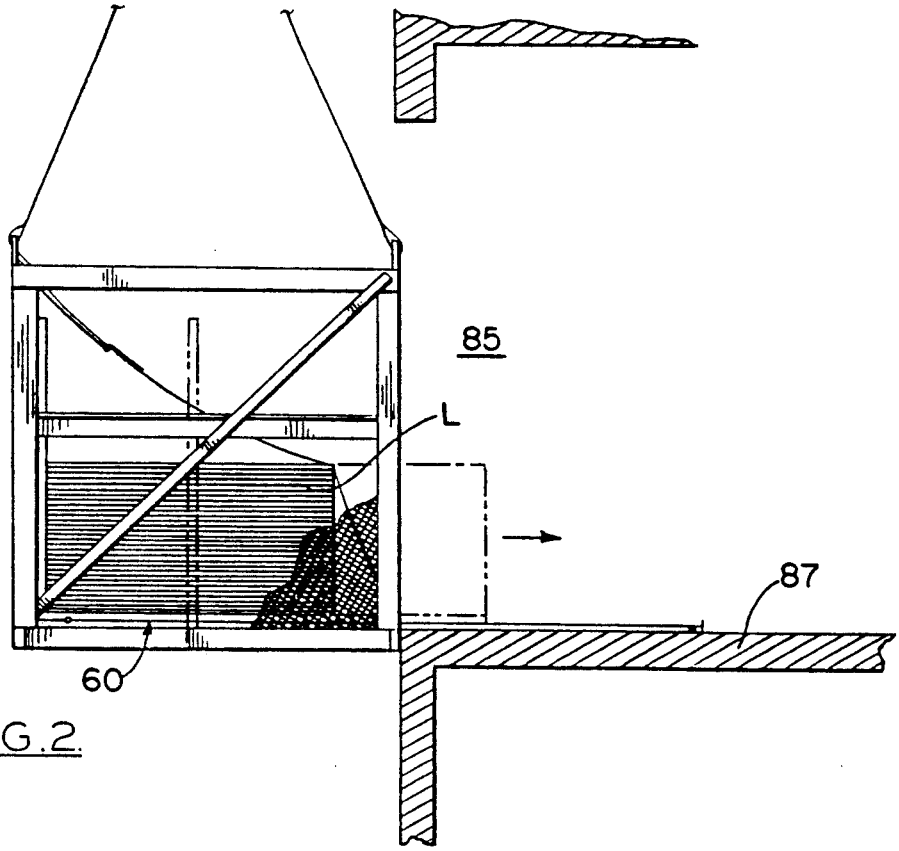
FIG. 2 is a side elevational view showing the material handling apparatus supported adjacent an elevated building opening and positioned for unloading the material onto the floor.

While the platform 12 rests on the ground, a load L such as sheet rock is positioned on the support members 62 (FIGS. 2 and 3). An attendant tightens the support straps 76 across the load L. A crane hook is lowered to engage a lift ring of the four cables connecting the corners of the platform 12. The platform 12 is raised to the required height and maneuvered to a position adjacent the elevated building opening 85 (FIG. 2). An attendant grasps the guide ropes by a hook or other means and then pulls the platform 12 by the guide ropes toward the building opening 85 so that the longitudinally extending beam members 42 are positioned inside the building opening. The crane lowers the platform 12 so that the longitudinally extending beam members 42 rest on the floor 87 (FIG. 2). Because the longitudinally extending beam members 42 are at a slight upward angle relative to the horizontal platform, as the beam members rest on the flat surface of the floor 87, the platform 12 is at a slight downward inclination relative to the floor. The attendant unhooks the support strap 76 and releases tension over the load L.

An attendant then rolls the support members 62 outward from the platform 12 and onto the portion of the beam members 42 resting on the floor 87. The support posts 68 and cross members 70 aid in retaining the load on the support members 62 during rolling. The attendant can use a rope previously tied to a support member or a hook (not shown) to aid in pulling the support members 62 forward. When the load L is positioned outside the confines of the platform 12, the tongs of a forklift can be inserted therebeneath between the respective longitudinally extending beam members 42 and the load raised and removed from the support members.

Additionally, the end plate shear pins 52 can be withdrawn and the end plates 50 removed. The support members 62 supporting the load thereon then can be rolled directly onto the floor 87 (FIG. 3). However, this is not preferred since the support members 62 must be lifted back onto the longitudinally extending beam members 42 so that the rollers 66 engage the guide passageway 48. Typically, the support members 62, rear support posts 68, and cross members 70 are made from steel or another strong, but heavy-weight construction material, thus making manual lifting of the structure back onto the longitudinally extending beam members 62 difficult. Thus, it is not preferred to allow the material transfer means 60 to roll off the beam members 42.

The present invention offers several benefits over other prior art apparatus. The apparatus can be positioned adjacent a building opening. A load then can be transferred onto the floor of an elevated building opening without the necessity of an attendant or an apparatus such as a forklift entering directly on the platform. Thus, the apparatus is safe and efficient for use in an area prone to high-risk dangers.

While a preferred embodiment of the invention has been specifically shown and described, this is for purposes of illustration only, not for purposes of limitation, the scope of the invention being in accordance with the hereinafter presented claims.

That which is claimed is

1. A material handling apparatus for lifting a load of material to an elevated position above ground level as in the construction of a multi-storied building and for facilitating the unloading of the lifted material in a safe manner, said apparatus comprising a substantially rectangular platform having opposing ends and a front and rear side, means carried by said platform for receiving a shackle or other cable attachment for raising or lowering the platform, extension means fixedly connected to and overlying said platform and extending laterally across said platform and laterally outwardly beyond said front side a predetermined fixed distance, said extension means having outer ends, removable stop means mounted on the outer ends of said extension means, and material transfer means for supporting a load of material movably mounted on said extension means and being moveable from a position overlying said platform outwardly beyond said front side to an extended unloading position while on the extension means or movable off the extension means by selective removal of said stop means for thereby permitting the unloading of material from the material transfer means without the necessity of entering onto said platform.

2. A material handling apparatus for lifting a load of material to an elevated position about ground level as in the construction of a multi-storied building and for facilitating the unloading of the lifted material in a safe manner, said apparatus comprising a substantially rectangular platform, a plurality of walls connected to said platform and extending upwardly therefrom, said plurality of walls including opposing end walls and a rear wall, said platform having an open front for ready access to the platform, means connected to upper portions of at least one of said plurality of walls for receiving a cable attachment for raising and lowering the platform, extension means fixedly connected to and overlying said platform and extending laterally across said platform and laterally outwardly through and beyond said open front a predetermined fixed distance, side extension means having outer ends, removable stop means mounted on the outer ends of said extension means, and material transfer means for supporting a load of material movably mounted on said extension means and being moveable from a position overlying said platform outwardly through said open front to an extended unloading position while on the extension means or movable off the extension means by selective removal of said stop means for thereby permitting the unloading of material from the material transfer means without the necessity of entering onto said platform.

* * * * *